US009561947B2

(12) United States Patent
Krieg et al.

(10) Patent No.: US 9,561,947 B2
(45) Date of Patent: Feb. 7, 2017

(54) METHOD OF REMOVING HEADSPACE FROM A FILLED CONTAINER AND CONTAINER COMPRISING A VALVE

(75) Inventors: Johannes Krieg, Vlaardingen (NL); Özgür Günyol, Vlaardingen (NL); Leon Bernard Oudehand, Vlaardingen (NL); Jonkheer Theodoor Hendrik van de Poll, Vlaardingen (NL)

(73) Assignee: Conopco, Inc., Englewood Cliffs, NJ (US)

( * ) Notice: Subject to any disclaimer, the term of this patent is extended or adjusted under 35 U.S.C. 154(b) by 526 days.

(21) Appl. No.: 14/119,460

(22) PCT Filed: May 7, 2012

(86) PCT No.: PCT/EP2012/058347

§ 371 (c)(1), (2), (4) Date: Nov. 22, 2013

(87) PCT Pub. No.: WO2012/163627

PCT Pub. Date: Dec. 6, 2012

(65) Prior Publication Data

US 2014/0102042 A1 Apr. 17, 2014

(30) Foreign Application Priority Data

Jun. 1, 2011 (EP) ..... 11168389
Aug. 18, 2011 (EP) ..... 11177891

(51) Int. Cl.
*B65D 51/16* (2006.01)
*B65D 33/01* (2006.01)
*B67C 3/22* (2006.01)

(52) U.S. Cl.
CPC ..... *B67C 3/222* (2013.01); *B65D 51/16* (2013.01); *B67C 3/223* (2013.01); *B65D 2205/025* (2013.01)

(58) Field of Classification Search
CPC . B65D 51/16; B65D 51/1611; B65D 51/1622; B65D 51/1644; B65D 51/165; B65D 31/147; B65D 33/01; B65D 2205/02; B65D 2205/025
(Continued)

(56) References Cited

U.S. PATENT DOCUMENTS 5,263,777 A 11/1993 Domke
5,515,994 A * 5/1996 Goglio ..... B65D 51/1616 220/371
(Continued)

FOREIGN PATENT DOCUMENTS

DE 1586778 10/1971
DE 19920761 6/2000
(Continued)

OTHER PUBLICATIONS

International Search Report, PCT/EP2012/058347, mailed Aug. 23, 2012, 5 pp.
(Continued)

*Primary Examiner* — Andrew M Tecco
*Assistant Examiner* — Praachi M Pathak
(74) *Attorney, Agent, or Firm* — Foley & Lardner LLP

(57) ABSTRACT

The invention relates to a method of removing headspace (3) from a filled container (1). The method comprises providing a container that is filled with a product (2) and that further holds a gas containing headspace. The container comprises a valve (100) that allows gas to be expelled from the container. The method further comprises applying a pressure difference over the one-way valve to remove gas contained in the headspace through the valve to reduce the headspace.

10 Claims, 3 Drawing Sheets

(58) Field of Classification Search
USPC ..... 53/397, 405, 408; 383/44, 45; 220/373, 220/374; 215/307, 308
See application file for complete search history.

(56) References Cited

U.S. PATENT DOCUMENTS

| | | | | |
|---|---|---|---|---|
| 6,065,642 | A | 5/2000 | Brown et al. | |
| 6,637,176 | B1 | 10/2003 | Krall et al. | |
| 7,490,623 | B2 * | 2/2009 | Rypstra ..... | B65D 77/225 137/246 |
| 2003/0035597 | A1 | 2/2003 | Buckingham et al. | |
| 2006/0225787 | A1 * | 10/2006 | Newrones ..... | B65D 33/2508 137/246 |

FOREIGN PATENT DOCUMENTS

| | | | |
|---|---|---|---|
| DE | 19920761 | C1 | 6/2000 |
| FR | 2951919 | A1 | 11/2009 |
| FR | 2951919 | | 5/2011 |
| WO | WO02070394 | A1 | 9/2002 |
| WO | WO2005000702 | | 1/2005 |
| WO | WO2009021094 | A1 | 2/2009 |
| WO | WO2011079301 | | 6/2011 |
| WO | WO2012163627 | A1 | 12/2012 |

OTHER PUBLICATIONS

European Search Report, EP 11 16 8389, dated Nov. 22, 2011, 2 pp.
IPRP2 in PCTEP2012058347, Aug. 19, 2013.
Search Report in EP11168389, Nov. 22, 2011.
Search Report in PCTEP2012058347, Aug. 23, 2012.
Written Opinion 1 in PCTEP2012058347, Aug. 23, 2012.
Written Opinion 2 in PCTEP2012058347, May 29, 2013.
Written Opinion in EP11168389, Nov. 22, 2011.

* cited by examiner

METHOD OF REMOVING HEADSPACE FROM A FILLED CONTAINER AND CONTAINER COMPRISING A VALVE

BACKGROUND

The present invention relates to a method of removing headspace from a filled container. The invention further relates to a method of filling a container with a product and a container holding a product.

PRIOR ART

When filling a container or bottle with a product, such as a pourable or viscous food product like ketchup or mayonnaise, it is difficult to fill the container such that no headspace (gas e.g. air) remains in the container.

Because of several reasons, such as tolerances in container production, tolerances in filling machines, prevention of spilling and thermal expansion of the product, containers are not filled exactly to the brim. The size of the containers varies as does the amount of product that is released by the filler. This leads to varying amounts of remaining space in the bottle or container, for instance in the neck and shoulders of a bottle, which commonly comprise air.

Having a little bit of air in the container on top of the product might form a negative experience to consumers thinking that their container hasn't been completely filled and therefore contains too little product, especially in transparent containers.

The amount of air may differ per container. Some containers are bigger and therefore can contain more headspace then smaller containers.

Headspace is specifically problematic in upside down containers. An upside down container may be a bottle with a cap covering the opening, where the cap comprises a flat portion arranged to support the container in upside down position, i.e. in a position with the opening directed in a downward direction.

The headspace in upside down containers may not be covered by a label, as is the case in right up bottles (cap up) in which the headspace and filling level is usually hidden by a neck label.

The presence of headspace is even more problematic in transparent upside down containers. The containers are filled in an upside up orientation with a high viscosity product. When the containers are positioned in the upside down orientation, this may lead to a "crack in the product" where part of the product falls down and part remains in the top with the air in the middle. This crack is visible for the consumer when buying this product.

For instance, U.S. Pat. No. 5,263,777 describes an overpressure valve for a packaging container, which prevents air from the atmosphere from getting into the package and, in the case of gas-emitting material being packaged, reduces a resultant overpressure by venting gas.

However, such one-way valves were not used for filling containers without headspace. Also, no one-way valve is disclosed that provide tamper evidence.

U.S. Pat. No. 6,065,642 describes a non-venting dispensing package for fluid products, comprising:

a container shaped to retain a selected fluid product within a predetermined volume, and having an interior wall construction configured to reduce said predetermined volume as fluid product is dispensed from said package, and including a discharge opening therein;

a dispensing valve for controlling the flow of the fluid product from said container; and a vent resisting pad dispos the container inclines to return to its undeformed shape and wherein ed on said exterior surface of said valve head portion adjacent said orifice, and retaining said orifice in said closed position after each dispensing of fluid product from said container to prevent ambient air from being drawn through said orifice into said container.

Because the interior volume of the containers described in U.S. Pat. No. 6,065,642 reduces as fluid product is dispensed therefrom, no underpressure is generated within the container during dispensing.

WO 02/070394 describes a method for filling and closing containers with a reduced headspace, said method comprising pouring liquid into the container, reversibly deforming the container so as to reduce the inner volume of the container, applying a sealing insert and closing the container with the aid of a closure.

SUMMARY

It is an object to provide a method of removing headspace from a filled container. Another object is to provide a method of filling a container with no or at least a reduced headspace. A further object is to provide a container without headspace.

According to a first aspect there is provided a method of removing headspace from a filled container, said method comprising:

a) providing a container that is filled with a product and that further holds a gas containing headspace, said container comprising a valve that allows gas to be expelled from the container; and b) applying a pressure difference over the valve to remove gas contained in the headspace through the valve to reduce the headspace.

Such a method allows to remove headspace from filled containers in an efficient way. The valve may be a one-way valve which prevents gas from entering the container after performing action b). Examples of such one-way valves are presented below. This allows easy further processing of the containers. After performing action b) the container remains at underpressure.

The headspace may for instance represent up to 10 vol. % of the interior volume of the container. After applying this method, the headspace may be reduced to 0-5 vol. % or preferably to 0-1 vol. %.

In an embodiment the container is a deformable container and a positive pressure is applied to the container by deforming the container. The term positive pressure is used to indicate that the pressure inside the container is increased. By deforming the container the gas is expelled from the container through the valve. Deforming the container may be done in many ways, such as by squeezing the container mechanically from the outside.

In an embodiment the container is a deformable container and the pressure difference is applied by squeezing the container. The pressure may be described as a positive pressure. The container may for instance be squeezed by transporting the container between to guiding elements that are positioned at a distance slightly smaller than the relevant dimension of the container.

In an embodiment the pressure difference is applied by providing a low pressure (compared to the pressure inside the container) at an outside of the valve. A pressure difference may also be applied by providing a low pressure at the outside of the container, sucking the gas out of the container.

In an embodiment b) comprises deforming the container from an undeformed shape to a deformed shape, wherein the internal volume of the container is reduced. Deforming the container such that the internal volume is reduced will expel the gas from the container. Normally, the container will be made of an elastically deformable material. When a user first opens the container, it will then regain its undeformed shape. As the headspace is normally very small with respect to the total volume of the container, the undeformed shape will hardly be noticeable by consumers.

In an embodiment the valve comprises an inner layer and an outer layer positioned on top of each other, the inner layer and outer layer each comprising at least one perforation that are positioned off-set with respect to each other, the outer layer having a higher modulus of elasticity. The inner and outer layer may comprise two or more sub-layers.

This is an advantageous way of forming a one-way valve. Such a one-way valve has the advantage that the pourable or viscous product can't easily flow through the one-way valve. It is thus ensured that by applying the pressure difference, only the gas forming the headspace is expelled and no product is expelled from the container. The perforations have a size chosen such that gas may be expelled easily, while the product cannot travel through the valve easily. The exact size of the perforations may depend on the viscosity of the product. Also, such a one-way valve allows to seal the one-valve after the headspace is removed in a relatively easy way, thereby providing a reliable and possibly aseptic closure of the container, which may also function as tamper evidence.

According to an embodiment valve comprises a filter layer. The filter layer may be a paper filter, a cellulose filter, a glass microfiber filters (GMF), a membrane filter or a synthetic foil with micro-perforations. The filter layer may have openings that are big enough for gas or air, but too small for the product. The filter layer may comprises a plurality of surrounding layers each comprising a plurality of holes, wherein the holes of at least one surrounding layer are not aligned with the other holes, to allow permanently closing the valve by sealing.

In an embodiment the valve only allows gas to be expelled. The valve may be designed that it does not let through the product, or at least not with the applied pressure difference.

In an embodiment b) comprises monitoring the applied pressure difference not to exceed a predetermined value. This way expelling of the product can be prevented, as expelling the product through the valve will require a significantly higher pressure difference than expelling of gas.

In an embodiment the method further comprises c) permanently closing the valve. This provides a reliable, possibly aseptic closure of the container. Also, the closed valve provides tamper evidence.

According to an embodiment the valve comprises an inner layer and an outer layer positioned on top of each other, wherein action c) comprises sealing the inner and outer layer together. Sealing may be done by heat or induction sealing.

According to an embodiment action c) comprises sealing the valve (100).

According to an aspect there is provided a method of filling a container with a product, the method comprising filling a container with the product, providing a valve that allows gas to be expelled from the container; and applying the method of removing headspace from a filled container according to the above.

The valve may be provided in an opening of the container which is to be used by a user to get the product out of the container. In case the container is filled through the opening, the valve will be provided after filling. However, in case the container is not filled via this opening and/or the valve is not provided in the opening, the valve may be provided before filling. The valve may be a one-way valve.

According to an embodiment, the method comprises labelling the container before applying the method of removing headspace from a filled container. This is advantageous as it is relatively difficult to apply a label to a container that has been subjected to the method of reducing the headspace as described above, as after applying this method, the walls of the container are slightly deformed making it more difficult to apply a label.

According to an aspect there is provided a container holding a product, wherein the container is at least partially deformable and comprises an opening for dispensing the product, the container comprises a valve that allows gas to be expelled from the container and the opening being closed, wherein the container is made of an elastically deformable material, the container having a deformed shape, the deformed shape being deformed with respect to an undeformed shape, wherein the container inclines to return to its undeformed shape and wherein the internal volume in the deformed shape is less than the interval volume of the container in the undeformed shape. The valve may be a one-way valve which prevents gas from entering the container.

In an embodiment the container comprises a valve that allows gas to be expelled from the container.

In an embodiment the valve is in the opening of the container. The valve may be attached to the container in such a way that it can easily be removed by a consumer before use.

In an embodiment the valve comprises an inner layer and an outer layer positioned on top of each other, the inner layer and outer layer each comprising at least one perforation that are positioned off-set with respect to each other, the outer layer having a higher modulus of elasticity.

According to an embodiment valve comprises a filter layer.

In an embodiment the one-way valve comprises a seal sub-layer which melts when heated provided at an interface of the inner layer and the outer layer to seal the inner and outer layer together.

In an embodiment the valve only allows gas to be expelled.

In an embodiment the valve is permanently closed.

In an embodiment the valve comprises an inner layer and an outer layer positioned on top of each other, wherein the inner layer and outer layer are sealed together.

In an embodiment an inside of the container has an underpressure with respect an outside of the container.

In an embodiment the container is made of an elastically deformable material.

The various aspects discussed in this patent can be combined in order to provide additional advantages.

BRIEF DESCRIPTION OF THE DRAWINGS

The invention will be described in more detail below with reference to a number of drawings which show a few exemplary embodiments. The drawings are only intended for illustrative purposes and do not limit the scope of protection which is defined by the claims.

DETAILED DESCRIPTION

The embodiments provide a method of filling a container with a pourable product and method of removing the headspace from a container (such as a bottle). A container may be filled with a product, leaving some headspace. A (one-way) valve may be provided, for instance in the opening of the container. Next, pressure may be exerted on the container squeezing out the gas forming the headspace. The valve prevents gas or air from flowing into the container.

The methods are explained with reference to FIGS. 1*a*-1*e*.

Figure 1A:
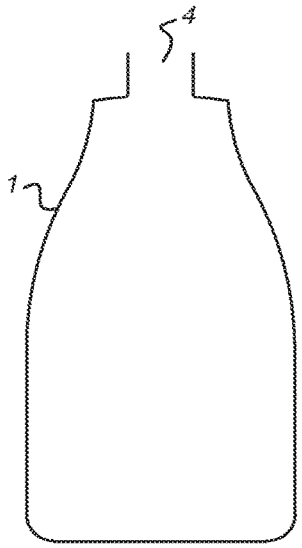
FIGS. 1*a-e* schematically show an embodiment of a method of filling a container, FIGS. 2*a-c* schematically depict a one-way valve in more detail, FIGS. 3*a-b* schematically depict a conveyor belt according to embodiments, FIG. 4 schematically depicts a one-way valve according to a further embodiment.

FIG. 1*a* shows a container 1. The container 1 may be bottle or the like which can be filled with a product 2. The container 1 comprises an opening 4, for instance shaped as a spout.

The container 1 may be an elastically deformable container meaning that the container 1 may be deformed into a deformed shape by exerting a force or applying over/underpressure, and the container 1 inclines to return to its undeformed shape.

The container 1 may be made of PET (Polyethylene terephthalate) or PP (Polypropylene), PE (Polyethylene) or may a multilayer container of different materials.

Figure 1B:
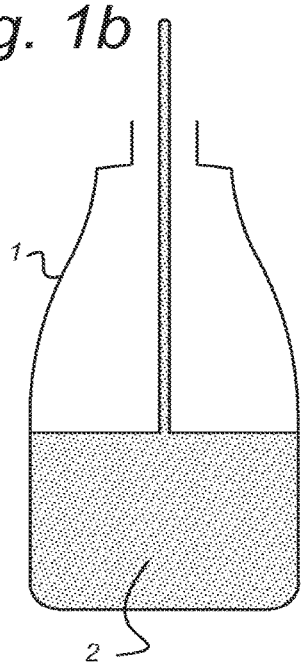

FIG. 1*b* schematically depicts the filling of a container with the product. The product 2 may be a food product. The product may be a liquid, a gel-like or a paste-like product. Examples of products are ketchup, mayonnaise, sauces. The product may also be a granular product, like flour or grain. The product may also be a non-food product, like soap, cleaning agent, washing powder, etc.

Figure 1C:
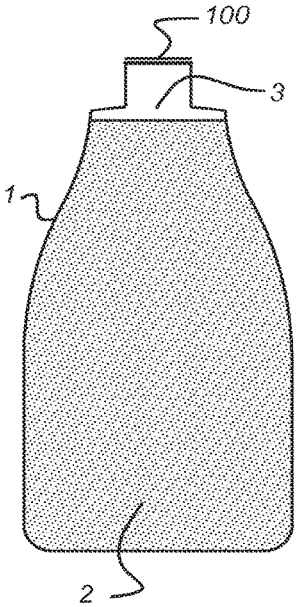

FIG. 1*c* schematically shows the container 1 now filled with the product 2. As shown in FIG. 1*c*, the container 1 comprises a headspace 3 comprising gas or air and which may be up to 10 vol. % of the total volume of the container 1.

Further shown in FIG. 1*c*, a one-way valve 100 is provided, positioned in the opening 4 of the container 1. The one-way valve 100 may be a pressure activated one-way valve 100. The one-way valve 100 is arranged to allow gas and air to flow out of the container 1, but prevents air and gas from entering the container 1. The one-way valve 100 is further arranged to prevent the product from flowing in or out of the container 1. The details of the one-way valve 100 will be explained in more detail below with reference to FIGS. 2*a*-2*c*. The details of an alternative valve 100 will be explained in more detail below.

Figure 1D:
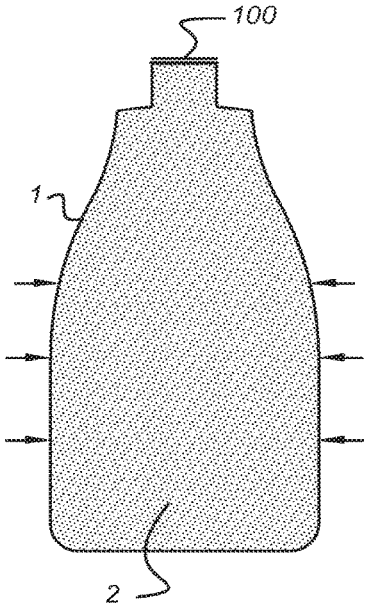

Next, a pressure difference is applied over the one-way valve 100, as schematically shown in FIG. 1*d*. This may be done by deforming the container 1, e.g. by squeezing the container 1. Different ways of applying the pressure difference will be explained in more detail below with reference to FIGS. 3*a*-3*b*.

Alternatively, the pressure difference is applied by providing a low pressure at an outside of the one-way valve thereby causing the container 1 to deform.

By applying the pressure difference, the gas in the headspace 3 is pushed out of the container 1 via the one-way valve 100, as shown in FIG. 1*d*. As the one-way valve 100 does not let through the product 2, the product is not squeezed out of the container 1. As a result, the headspace is significantly reduced without spilling product 2.

Figure 1E:
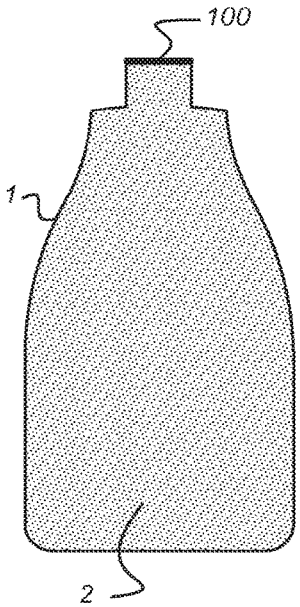

Optionally, the one-way valve 100 may be closed, as schematically shown in FIG. 1*e*. This is also explained in more detail below with reference to FIG. 2*c*.

The method as explained with reference to FIGS. 1*a*-1*e* may be employed with any suitable valve, such as the valves explained with reference to FIGS. 2*a*-2*c*.

Figure 2A:
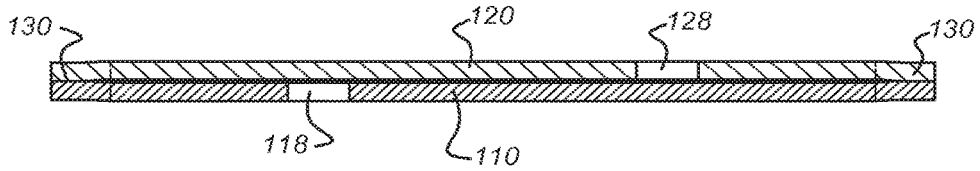
Figure 2B:
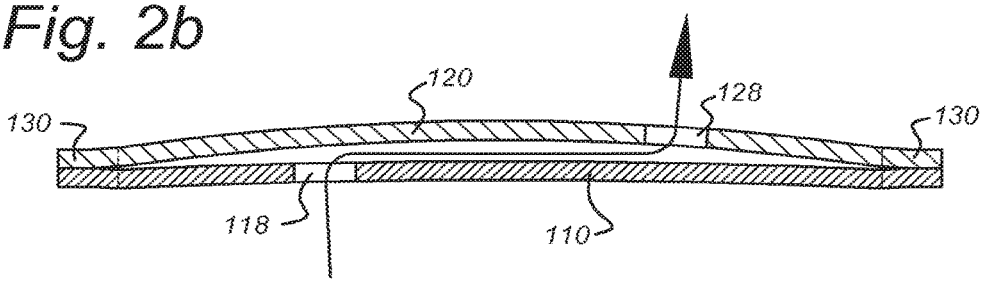
Figure 2C:
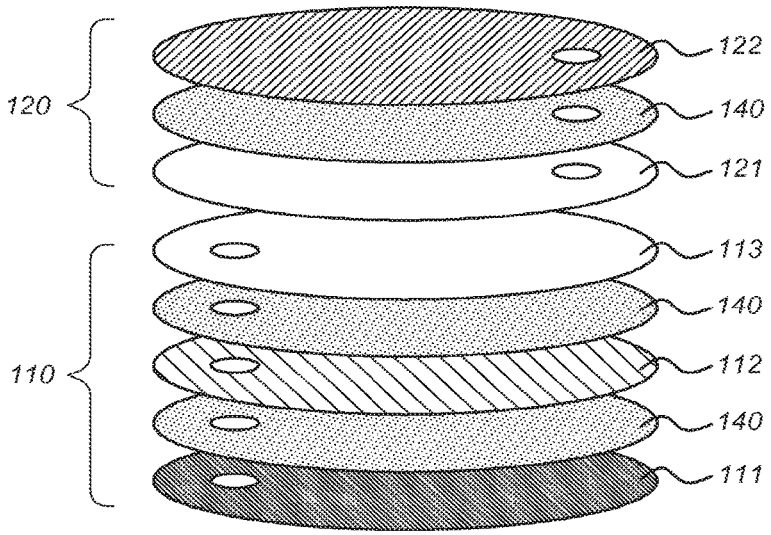

FIG. 2*a* schematically depicts a one-way valve 100 as may be used.

The one-way valve 100 comprises at least two layers: an inner layer 110 and an outer layer 120, as shown in FIG. 2*a*. When attached to the container 1, for instance in the opening 4, the inner layer 110 faces the inside of the container 1.

The inner and outer layer 120 are made of a flexible material, such as a flexible foil, with a different modulus of elasticity (tendency to be deformed elastically when a force is applied to it).

The inner layer 110 has a relatively low modulus of elasticity and the outer layer 120 has a relatively high modulus of elasticity.

Both layers 110, 120 each comprise at least one perforation 118, 128 in different positions, i.e. not in line with respect to each other.

The inner and outer layers 110, 120 may be joint along an edge region 130, leaving non-joint surfaces remaining in the middle. The non-joint surfaces are completely surrounded by the joint edge region 130. When a force is exerted to the layer 110, 120 in a direction from the inner layer 110 to the outer layer 120, for instance generated by a pressure difference, both layers 110, 120 deform as schematically depicted in FIG. 2*b*.

The outer layer 120 deforms more than the inner layer 110 as a result of the different moduli of elasticity. As a result a small open volume is created between both layers. When at the same time a force, which may also be created by a pressure difference is applied to the content of the container 1, the gas forming the headspace 3 is forced through the one-way valve 100 out of the container 1.

The product, which will have a higher viscosity than the gas, requires more force to go flow through the one-way valve 100 and will therefore not flow through the one-way valve 100.

This way, a one-way valve 100 is created which only let's trough gasses (e.g. air in the headspace) and not the product, such as pourable and/or viscous products.

Also, when the force is applied to the one-way valve from the outside to the inside of the container 1, thereby deforming the inner and outer layer 110, 120 in the direction of the inner layer 110, the outer layer 120 is pushed onto the inner layer 110 creating a gas-tight closure.

Optionally, after the headspace 3 is removed the one-way valve may be closed. This may be done to provide an even more fail-safe closure of the container 1 ensuring that no air or contamination can enter the container 1. Such a closed one-way valve seals the container 1 providing tamper evidence to a user.

So, according to the embodiment, a seal is provided that provides tamper evidence. The seal is also formed as one-way valve which let's through air in a direction out of the container 1 without letting through the product. With this one-way venting seal, the container 1 can be squeezed to push out all the air in the headspace which results in a container 1 with a no or at least a reduced headspace.

An embodiment of such a one-way valve which may be sealed is provided below with reference to FIG. 2*c*. By using layer materials that can be sealed trough for example heat sealing or induction sealing, the one-way valve can be constructed in such a way that it can be closed.

The inner layer 110 and/or the outer layer 120 may be formed by one or more sublayers.

The inner layer 110 comprises a first sub-layer 111 made of TPS (thermoplastic styrene), forming a sealing layer which may be sealed to the top of the neck of the container 1 forming the opening 4 to attach the one-way valve 100 to the container 1 by induction or heat sealing. The neck may have a flat surface on top to which the sealing layer is sealed.

The inner layer 110 further comprises a second sub-layer 112 being a conductive layer, such as an aluminum layer, which heats up when an oscillating electromagnetic field is applied.

The inner layer 110 further comprises a third sub-layer 113 being made of a thermoplastic material like expanded PE (Polyethylene) which is provided as a cushioning layer. This layer makes sure that the first sub-layer 111 fully touches the neck of the container so it is sealed well.

The outer layer 120 may comprise a first sub-layer 121 made of TPS (thermoplastic styrene), forming a sealing layer which may be sealed to the inner layer 110 by induction or heat sealing.

The outer layer 120 may further comprise a second sub-layer 122 forming a protection layer, for instance made of Polyethylene terephthalate. This layer prevents tearing of the seal tear when it is removed.

In between the sub-layers 111, 112, 113 of the inner layer 110 and in between the sub-layers 121, 122 of the outer layer 120, adhesive layers 140 may be provided.

The one-way valve 100 may be closed by induction sealing. By generating an oscillating electromagnetic field, for instance by an induction coil, the second sub-layer 112 heats up, the first sub-layer 121 facing the inner layer 110 melts and attaches to the inner layer 110.

The one-way valve 100 may go through a sealer, such as an induction or heat sealer, in which the second sub-layer 112 being a conductive layer heats up and seals the sealing layer 121 to an adjacent layer.

Of course, the number and order of the sub-layers may be varied. In order to provide a one-way valve 100 which can be closed by induction or heat sealing, the one-way valve 110 at least comprises:

- a heat-generating sub-layer 112 which generates heat under the influence of an oscillating electromagnetic field,
- a seal sub-layer 113 which melts by the heat generated by the heat-generating sub-layer 112 provided at the interface between the inner layer 110 and the outer layer 120.

The filter layer may be one of a paper filter, a cellulose filter, a glass microfiber filters (GMF), a membrane filter or a synthetic foil with micro-perforations.

The filter layer comprises relatively small openings which allow gas or air to travel through the filter layer, but which are too small to allow the product to travel through the filter layer. The filter layer allows gas to be removed from the headspace through the valve 100 to reduce the headspace, until the product reaches the filter layer.

In case a paper filter/cellulose filter layer is used, gas or air will no longer be able to travel through the filter layer once the filter layer is wetted by the product. This prevents gas or air from re-entering the container after the pressure difference has been removed. In that case, the valve 100 also functions as a one-way valve 100.

The filter layer may be a Grade 589/3 filter as supplied by Whatman®, having a particle retention in liquid of <2 μm, a thickness of 160 μm and weighs 84 g/m$^2$.

According to an embodiment, the valve 100 comprises a first sub-layer similar to the first sub-layer 111 described above, made of TPS (thermoplastic styrene). The first sub-layer may now comprise a plurality of holes which allows gas and/or air to pass. This first sub-layer faces the content of the container.

The valve 100 further comprises a second sub-layer provided on top of the first sub-layer, which is a conductive layer, such as an aluminum layer, which heats up when an oscillating electromagnetic field is applied. This second layer is similar to second sub-layer 112 described above, now comprising a plurality of holes which allows gas and/or air to pass, which are aligned with respect to the holes in the first sub-layer.

On top of the second sub-layer the filter layer is provided, which only allows gas and/or air to pass, but doesn't let through the product.

On top of the filter layer a third sub-layer is provided, made of TPS (thermoplastic styrene), forming a sealing layer. This third sub-layer is similar to first sub-layer 121 described above, now comprising a plurality of holes which allows gas and/or air to pass and which are aligned with respect to the holes in the first sub-layer and the second sub-layer.

The valve 100 further comprises a fourth sub-layer forming a protection layer, for instance made of Polyethylene terephthalate. This layer prevents tearing of the seal tear when it is removed and is similar to the second sub-layer 122 described above, but now comprises a plurality of holes, which are all not aligned with respect to the other holes. This allows to permanently close the valve 100 after sealing the third sub-layer to the fourth sub-layer.

According to this embodiment, all sub-layers and the filter layer may be joined together by a seal provided along the circumference of the valve 100, which may be a heat seal or an adhesive seal.

Different ways of applying the pressure difference will be explained in more detail below with reference to FIGS. 3*a*-3*b*.

Figure 3A:
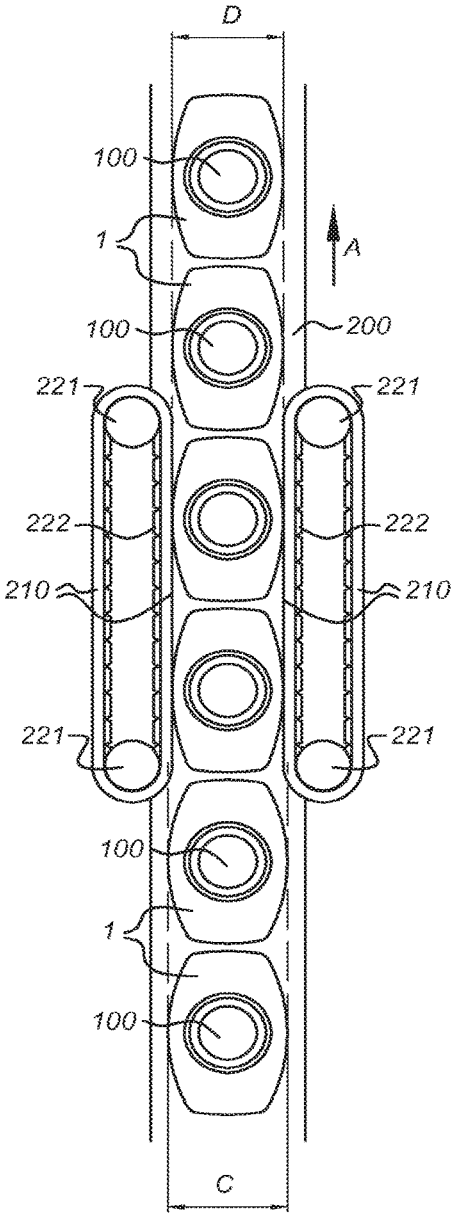
Figure 3B:
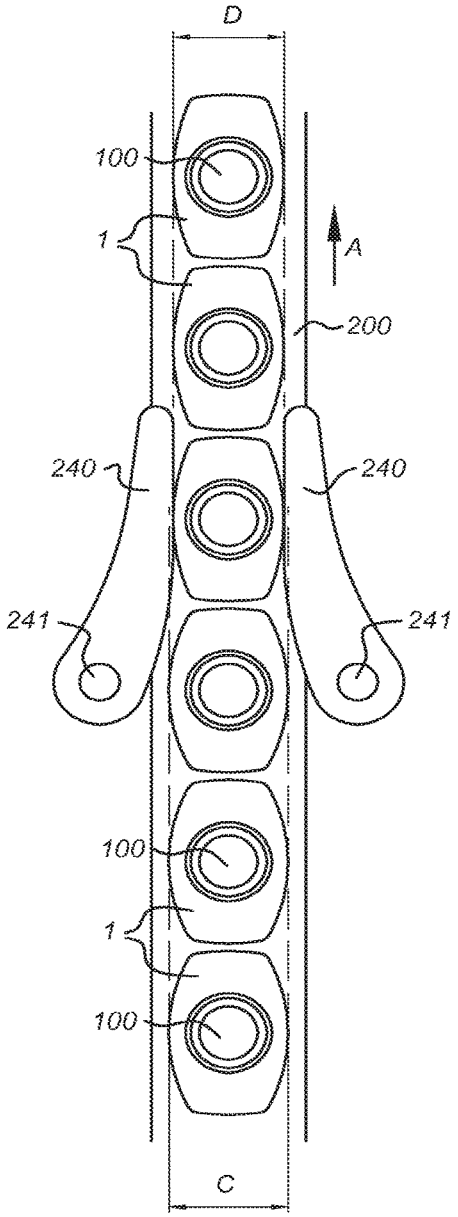

FIG. 3*a* schematically depicts a top view of a conveyor belt 200 transporting a plurality of containers 1. The containers 1 are filled with the product, comprise a headspace 3 and a suitable valve 100, such as a one-way valve 100. The conveyor belt moves in the direction indicated by arrow A.

Alongside the conveyor belt 200 a pressure applying device may be provided. The pressure applying device may comprise flexible bags 210 which can be inflated, for instance with air or foam. Two airbags 210 may be provided on opposite sides of the conveyor belt 200 in between which the containers 1 are transported.

The airbags 210 are arranged to move at substantially the same speed as the conveyor belt 200 along a predetermined portion of the conveyor belt 200 to reduce friction between the airbags 210 and the containers 1. As shown in FIG. 3*a*, the airbags 210 may be provided on an outside of an air bag conveyor belt 222, the air bag conveyor belt 222 being rotated by pulleys 221 in a direction indicated by arrow B.

The airbags 210 may further be connected to an air supply to inflate the air bags 210 to a predetermined pressure. In case the bags are to be filled with foam, the bags may be connected to a foam supply. In general, the bags may be connected to a source which can inflate the bags.

The airbags 210 are arranged in such a way that the space in between the airbags on opposite sides of the conveyor belt

200 is such that a pressure is applied to the containers 1 when travelling in between the airbags 210. The closest distance D between the two airbags is smaller than the corresponding size C of the containers 1. This way, the containers 1 are squeezed and the headspace is reduced or even removed.

Other pressure applying devices may be conceived as well, such as a pressure applying device in which members are pushed against the container by a spring. The members may move together with the containers. The members may also be static and comprise roller elements to prevent damage to the containers. The containers may also be stopped temporarily to apply pressure without the risk of damaging the containers.

According to an embodiment labels are attached to the container before the headspace is removed. By applying pressure by using bags, the risk of damaging labels attached to the container 1 is reduced.

After the headspace is removed, the one-way valve 100 may be permanently sealed, for instance by heat or induction sealing.

By using bags, such as airbags 210, pressure can be exerted in a controlled way without the risk of damaging the containers 1.

The amount of gas flowing through the one-way valve 100 out of the container 1 in relation to the applied pressure or force and the required pressure force to let through product depends on the elasticity moduli of the inner and outer layer 110, 120 and the differences between them, the size of the perforations 118, 128, the relative position of the perforations 118, 128 (distance between them), the size of the non-joint surface of the inner and outer layer 110, 120.

By optimizing these parameters, a one-way valve 100 can be created that for example let's through large amounts of air in high speed but prevents viscous liquids like ketchup or mayonnaise from going through.

According to an embodiment a pressure monitor may be provided monitors the pressure inside the airbags 210 to prevent the pressure exceeding a predetermined value. The predetermined value may be chosen such that it is ensured that no product can be squeezed out of the container 1.

Other embodiments to apply the pressure difference over the one-way valve 100 may be conceived. A further embodiment is shown in FIG. 3*b*, wherein the air bags 210 are replaced by two guiding elements 240 positioned on both sides of the conveyor belt 200. The guiding elements 240 may be hingeable about respective hinge axes 241. The guiding elements 240 may be actuated to apply a pressure to the containers 1. Alternatively, the guiding elements 240 may have a rest position in which their mutual closest distance is smaller than the corresponding size C of the containers 1. Two guiding elements 240 may be spring loaded such that a pressure is applied to the containers 1 when passing in between the guiding elements and pushing the guiding elements 240 further apart.

Advantages

A liquid tight one-way valve is provided that allows gas through in one-way but does not allow liquid or viscous materials to travel through the one-way valve.

The one-way valve may also be used to seal the container. The one-way valve is used once after the container is filled. The one-way valve is provided in the opening of the container 1 which will be used by users to obtain the product, so no additional opening is needed in the container.

It will also be obvious after the above description and drawings are included to illustrate some embodiments of the invention, and not to limit the scope of protection. Starting from this disclosure, many more embodiments will be evident to a skilled person which are within the scope of protection and the essence of this invention and which are obvious combinations of prior art techniques and the disclosure of this patent.

The invention claimed is:

1. A method of removing headspace from a filled container, said method comprising:

a) providing a container that is filled with a product and that further holds a gas containing headspace, wherein the container is at least partially deformable and comprises an opening for dispensing the product, said container comprising a valve that allows gas to be expelled from the container; and the container is made of an elastically deformable material, the container having a deformed shape, the deformed shape being deformed with respect to an undeformed shape, wherein the container inclines to return to its undeformed shape and wherein the internal volume in the deformed shape is less than the internal volume of the container in the undeformed shape, wherein the valve comprises an inner layer and an outer layer positioned on top of each other, the inner layer and outer layer each comprising at least one perforation that are positioned off-set with respect to each other, wherein the inner layer and outer layer are made of a flexible material, the outer layer having a higher modulus of elasticity, and wherein the inner layer and the outer layer are formed by one or more sublayers, the inner layer comprising a first sub-layer made of thermoplastic styrene, the inner layer further comprising a second sub-layer being a conductive layer, such as an aluminum layer, which heats up when an oscillating electromagnetic field is applied, the inner layer further comprising a third sub-layer being made of a thermoplastic material like expanded polyethylene, the outer layer comprising a first sub-layer made of thermoplastic styrene, the outer layer further comprising a second sub-layer forming a protection layer, for instance made of polyethylene terephthalate, and wherein the one-way valve may be closed by induction sealing, by generating an oscillating electromagnetic field, for instance by an induction coil, to heat up the second sub-layer, leading to melting of the first sub-layer facing the inner layer and attaching to the inner layer, and b) applying a pressure difference over the valve to remove gas contained in the headspace through the valve to reduce the headspace.

2. A method according to claim 1, wherein the container is a deformable container and a positive pressure is applied to the container by deforming the container.

3. A method according to claim 1, wherein in between the sub-layers of the inner layer and in between the sub-layers of the outer layer, adhesive layers are provided.

4. A method according to claim 1, wherein valve comprises a filter layer.

5. A method according to claim 1, wherein b) comprises monitoring the applied pressure difference not to exceed a predetermined value.

6. A method according to claim 1, wherein the method further comprises;

c) permanently dosing the valve.

7. A method according to claim 6, wherein the valve comprises an inner layer and an outer layer positioned on top of each other, wherein action c) comprises sealing the inner and outer layer together.

8. A method according to claim 6, wherein action c) comprises sealing the valve.

9. A method of filling a container with a product, the method comprising:

filling a container with the product, providing a valve that allows gas to be expelled from the container; and applying the method according to claim 1.

10. A method according to claim 9, wherein the method comprises labelling the container before applying the method of removing headspace from a filled container.

* * * * *